US011178919B2

(12) United States Patent
Mazzarolo et al.

(10) Patent No.: US 11,178,919 B2
(45) Date of Patent: Nov. 23, 2021

(54) GARMENT FOR MOTORCYCLISTS

(71) Applicant: Alpinestars Research S.p.A., Maser (IT)

(72) Inventors: Giovanni Mazzarolo, Coste di Maser (IT); Tomaso Bacigalupo, Asolo (IT)

(73) Assignee: ALPINESTARS RESEARCH S.P.A., Maser (IT)

( * ) Notice: Subject to any disclaimer, the term of this patent is extended or adjusted under 35 U.S.C. 154(b) by 241 days.

(21) Appl. No.: 16/348,178

(22) PCT Filed: Nov. 10, 2017

(86) PCT No.: PCT/EP2017/078889
§ 371 (c)(1),
(2) Date: May 8, 2019

(87) PCT Pub. No.: WO2018/087290
PCT Pub. Date: May 17, 2018

(65) Prior Publication Data

US 2019/0364989 A1 Dec. 5, 2019

(30) Foreign Application Priority Data

Nov. 14, 2016 (IT) ..... 102016000114569

(51) Int. Cl.
*A41D 3/00* (2006.01)

(52) U.S. Cl.
CPC ..... *A41D 3/00* (2013.01); *A41D 2400/38* (2013.01); *A41D 2600/102* (2013.01)

(58) Field of Classification Search
CPC . A41D 3/00; A41D 2400/38; A41D 2600/102
See application file for complete search history.

(56) References Cited

U.S. PATENT DOCUMENTS 1,169,256 A 1/1916 Grimm et al.
3,086,214 A 4/1963 Lash
(Continued)

FOREIGN PATENT DOCUMENTS

DE 2059046 A1 8/1971
EP 0950360 A2 10/1999
(Continued)

OTHER PUBLICATIONS

PCT International Search Report and Written Opinion dated Dec. 22, 2017 for International Application No. PCT/EP2017/078889, from which the instant application is based, 10 pgs.
(Continued)

*Primary Examiner* — Khaled Annis
(74) *Attorney, Agent, or Firm* — Fredrikson & Byron, P.A.

(57) ABSTRACT

The present invention relates to a garment for motorcyclists (10) comprising a panel (12) formed by two elastic inserts (14), each elastic insert (14) having a first portion (141), positioned underneath the respective armpit, along the side of the upper portion of the trunk, and a second portion (142), inclined upwards over the respective shoulder blade, and by an elastic band (16), crosswise positioned along the bottom portion of the back. According to the invention the two elastic inserts (14) are connected to the elastic band (16) by means of at least one not-stretchable element (18), running along the sides of the torso. Moreover the garment (10) comprises two further stretchable pieces (20), each stretchable piece (20) running along the inner side of the sleeve from the wrist up to the armpit and being provided with an extension (22) extending along the adjacent side of the upper portion of the trunk and joined to the first portion (141) of the adjacent elastic insert (14).

15 Claims, 8 Drawing Sheets

(56) References Cited

U.S. PATENT DOCUMENTS

| | | | | |
|---|---|---|---|---|
| 4,195,362 | A | 4/1980 | Rolando | |
| 5,091,992 | A * | 3/1992 | Pusic | A41D 13/018 2/16 |
| 5,109,546 | A * | 5/1992 | Dicker | A41D 1/08 2/70 |
| 5,201,074 | A * | 4/1993 | Dicker | A41D 13/0015 2/227 |
| 6,231,488 | B1 * | 5/2001 | Dicker | A41D 13/0015 2/69 |
| 8,887,315 | B2 * | 11/2014 | Boynton | A63B 21/055 2/44 |
| 2005/0210559 | A1 * | 9/2005 | Gabriele | A41D 31/185 2/69 |
| 2012/0311760 | A1 * | 12/2012 | Puni | A41B 1/08 2/69 |
| 2013/0167285 | A1 * | 7/2013 | Decker | A41D 1/089 2/69 |
| 2013/0316617 | A1 * | 11/2013 | Freddi | A41D 1/08 450/95 |
| 2014/0317826 | A1 * | 10/2014 | Decker | A41D 13/0015 2/69 |
| 2014/0331375 | A1 * | 11/2014 | Howland | F41H 1/02 2/2.5 |
| 2015/0173433 | A1 * | 6/2015 | Mazzarolo | A41D 13/018 2/461 |
| 2017/0290382 | A1 * | 10/2017 | Arnold | A41D 31/102 |

FOREIGN PATENT DOCUMENTS

| | | | |
|---|---|---|---|
| EP | 1555900 | B1 | 7/2005 |
| EP | 2373188 | B1 | 2/2012 |
| EP | 2849591 | B1 | 1/2016 |
| FR | 2476453 | A1 | 8/1981 |
| JP | 6082410 | U | 6/1985 |
| JP | 71016 | U | 1/1995 |

OTHER PUBLICATIONS

"Spidi Track Wind Pro Race Suit from SportbikeTrackGear.com", Retrieved from YouTube: https://www.youtube.com/watch?v=ZSDyxWIw_GM, published Feb. 8, 2012, 3 pages.

"Spidi Warrior Wind Pro Suit Review from Sportbiketrackgear.com", Retrieved from YouTube: https://www.youtube.com/watch?v=fTPkTgcmWI4, published Feb. 26, 2015, 3 pages.

"Spidi Track Wind Pro Replica Race Suit Review at RevZilla.com", Retrieved from YouTube: https://www.youtube.com/watch?v=KT6K1jbOtnM, published May 21, 2014, 3 pages.

"Spidi Track Wind Pro Race Suit Review at RevZilla.com", Retrieved from YouTube: https://www.youtube.com/watch?v=JQqRr6Lo0sQ, published Jan. 9, 2012, 4 pages.

"Spidi Track Wind Replica EVO Race Suit Review at RevZilla.com", Retrieved from YouTube: https://www.youtube.com/watch?v=ZrOKg7kbtnw, published Dec. 20, 2014, 3 pages.

"Spidi Track Wind Pro Replica One-Piece Motorcycle Suit at BikeBandit.com", Retrieved from YouTube: https://www.youtube.com/watch?v=ErQlrum42Pw, published Dec. 23, 2013, 3 pages.

"Spidi T-2 WindPro One-Piece Leather Suit", Retrieved online: https://www.triumphrat.net/threads/spidi-t-2-windpro-one-piece-leather-suit.178045/, dated Jun. 23, 2011, 6 pages.

"Tuta Spidi Track Wind Pro", Retrieved online: https://www.moto.it/accessori/prodotti/tuta-spidi-track-wind-pro.html, published Apr. 3, 2013, 10 pages (including 5 pages English Machine Translation).

European Patent No. 3537909, Notice of Opposition dated Jun. 9, 2021, 48 pages.

* cited by examiner

GARMENT FOR MOTORCYCLISTS

RELATED APPLICATIONS

This application is a 35 U.S.C. 371 national stage filing from International Application No. PCT/EP2017/078889, filed Nov. 10, 2017, which claims priority to Italian Application No. 102016000114569, filed Nov. 14, 2016, the teachings of which are incorporated herein by reference.

The present invention relates to a garment for motorcyclists with improved comfort. In particular, the present invention refers, even if in a non-exclusive way, to a suit for motorcyclists, namely to a garment used by motorcyclists wherein a pair of trousers is inseparably joined to a body-piece.

However, as it will be clear from the following description, advantageously the teachings of the present patent application might also be applied to jackets or body-pieces on their own, as well as to a suit formed by a jacket removably joined to a pair of trousers.

The suits used by motorcyclists from one side must adhere to the body of the user to avoid undesirable aerodynamic effects. On the other side the suits must not hinder the movements of the user, especially when the latter is sitting on the saddle of the motorcycle.

For managing such contrasting requirements, the suits designed for motorcyclists are usually made of inextensible material, generally leather, to which a number of elastic inserts is applied.

A first example of suit for motorcyclists is disclosed in EP0950360 which envisages a leather suit provided with an elastic strip in the form of a U, applied along the two sides of the trunk and along the bottom of the back.

The elastic strip is formed by three pieces of elastic fabric cut out at the sides and at the rear portions in such a manner that the direction of greatest elastic yielding is perpendicular to the line of longitudinal development of the strip.

Such a solution, even if it is appreciated, has some drawbacks.

The first issue is that the manufacture of the suit is complex, since the U-shaped strip is obtained by forming separately its three parts and then sewing them together. In a second moment, the strip is applied to the suit, while maintaining it stretched to its maximum extent.

The second issue is that the back panel of the suit, which is partially encircled by the U-shaped elastic strip, in case of an accident, while the rider slides or tumbles for a long time on his back, can be subjected to movements which can cause a displacement of the protections, for example the back protections.

Therefore, in case of a sliding along the back, there is the risk that some portions of the user's body are not adequately protected due to such a displacement.

A second example of suit for motorcyclists is disclosed in EP 1555900, in the name of the present applicant, which envisages a leather suit provided with an elastic insert, limited to the bottom of the back, and with two inserts in the form of an overturned "L", applied along the sides of the user.

In detail, these overturned L shaped inserts have a first side, designed to extend along all the sides of the trunk, underneath the armpits, and a second side, inclined towards the shoulders.

Each elastic insert is made using a technique which is well-known to specialist of the sector, namely by superimposing and joining a layer of thin elastic fabric to a layer of leather. A series of closely arranged transverse stitches are performed when the layer of elastic fabric is fully tensioned with the result that a plurality of folds are created when the suit is in rest condition. The inserts so obtained are identified in the technical jargon as "accordion leather stretch inserts".

The overturned L shaped elastic inserts are thus provided with a plurality of folds and they are applied to the suit in such manner that the angle formed by the folds with the longitudinal axis of the trunk is about 45 degrees.

In this way, these overturned L shaped elastic inserts favor both raising the arms of the rider and arching of the back, during riding of the motorcycle.

Such a solution is greatly appreciated. However, in recent times, the developments introduced in the structure and in the compounds of the tires and the use of various electronic controls have caused changes in the riding style of the riders.

As a matter of fact, the riders recently started to lean off the bike extending the elbow further down and further forward with respect to what done previously.

Therefore, the suit is requested to offer extra flexibility into the shoulder area without affecting its aerodynamics properties.

To meet such a further need, stretchable panels have been positioned on the inner side of the sleeves of the suit, namely on the portion of the sleeves that is closer to the sides of the trunk, when the arms are adherent to the body.

However, such additional stretchable panels may cause a comfort issue in the suit, since often some folds are formed in the area underneath the armpits.

Moreover, the provision of stretchable inserts running along all the sides of the trunk does not allow to provide the suit with side protections. As a matter of fact protections, like for example rigid or semi-rigid pads, cannot be fixed to the accordion leather stretch inserts positioned there.

Furthermore, the solution disclosed in EP 1555900 involves the use of a certain number of accordion leather stretch inserts which affects the weight of the suit itself.

The object of the present invention is to provide a garment for motorcyclists which solves at least partly the above mentioned problems and drawbacks.

In particular, an aim of the present invention is to provide a garment for motorcyclists having an improved comfort without affecting the weight and the aerodynamics of the garment.

Moreover, an aim of the present invention is to provide a garment for motorcyclists offering an improved protection to the user, in particular at the sides and at the back of the user.

A further aim of the present invention is to provide a garment for motorcyclists having a simplified construction.

These and other objects and aims are achieved by the garment according to claim 1.

The advantages and the characteristic features of the invention will appear more clearly from the following description of preferred, but not exclusive, embodiments of the garment with reference to the accompanying figures in which.

Figure 1:
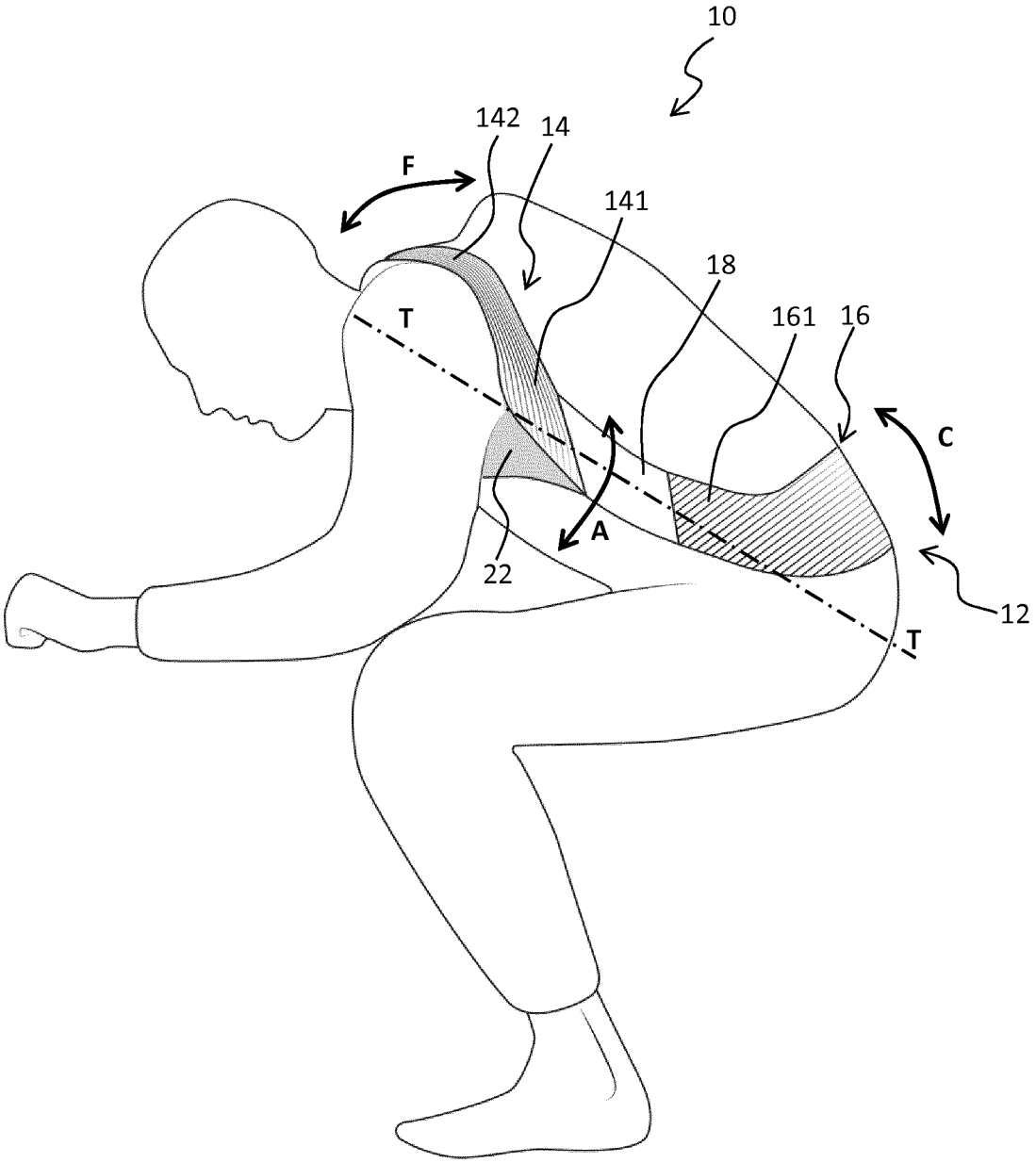
FIG. 1 shows a side view of a first embodiment of the garment according to the invention.

With reference to the attached figures, an example of a garment for motorcyclists according to the invention is indicated as a whole by the reference 10.

In the attached figures a one-piece suit is shown. However, a garment according to the present invention can be manufactured as a jacket or a body-piece removably joined to a pair of trousers.

The garment 10 is preferably made with a material resistant to abrasion, for example leather or leather-like material.

As shown in the attached figures, the garment 10 comprises a panel 12 designed to be positioned at the back portion of the garment 10.

The panel is formed by two elastic inserts 14 and by an elastic band 16.

Each elastic insert 14 has a first portion 141, designed to be positioned underneath the respective armpit, along the side of the upper portion of the trunk, and a second portion 142, inclined upwards over the respective shoulder blade. Preferably first portion 141 and second portion 142 are a single piece.

The elastic band 16 is crosswise positioned along the bottom portion of the back. According to the invention the two elastic inserts 14 are connected to the elastic band 16 by means of at least one not-stretchable element 18, running along the sides of the trunk.

Moreover the garment 10 comprises two further stretchable pieces 20.

Figure 2:
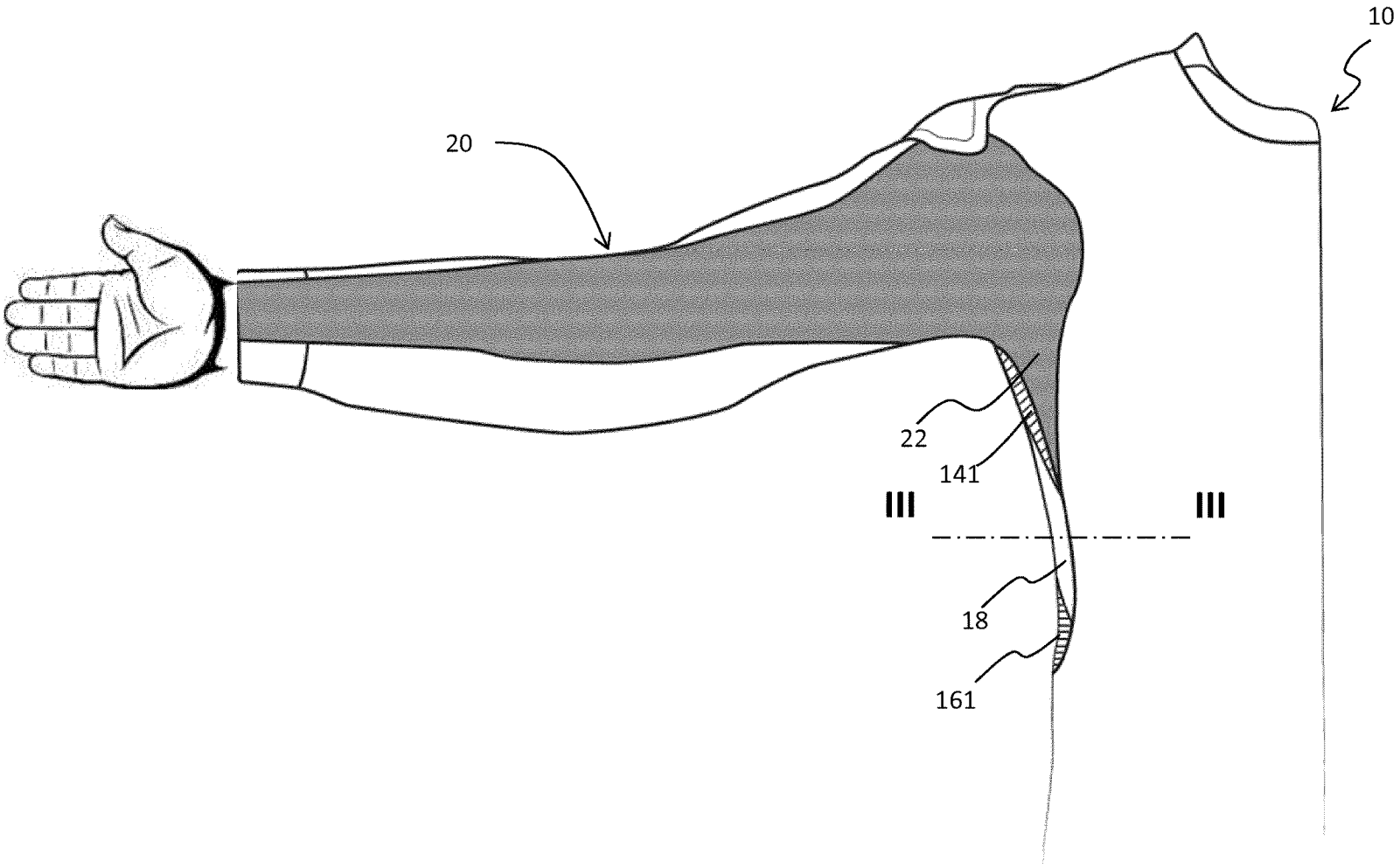
FIG. 2 shows a detail of the garment of FIG. 1.

As it is clearly shown in FIG. 2, each stretchable piece 20 runs along the inner side of the sleeve, from the wrist up to the armpit. In the following description, as inner side of the sleeve there will be indicated the portion of the sleeve closer to the user's body, when the user extends his arms along the sides.

Figure 5:
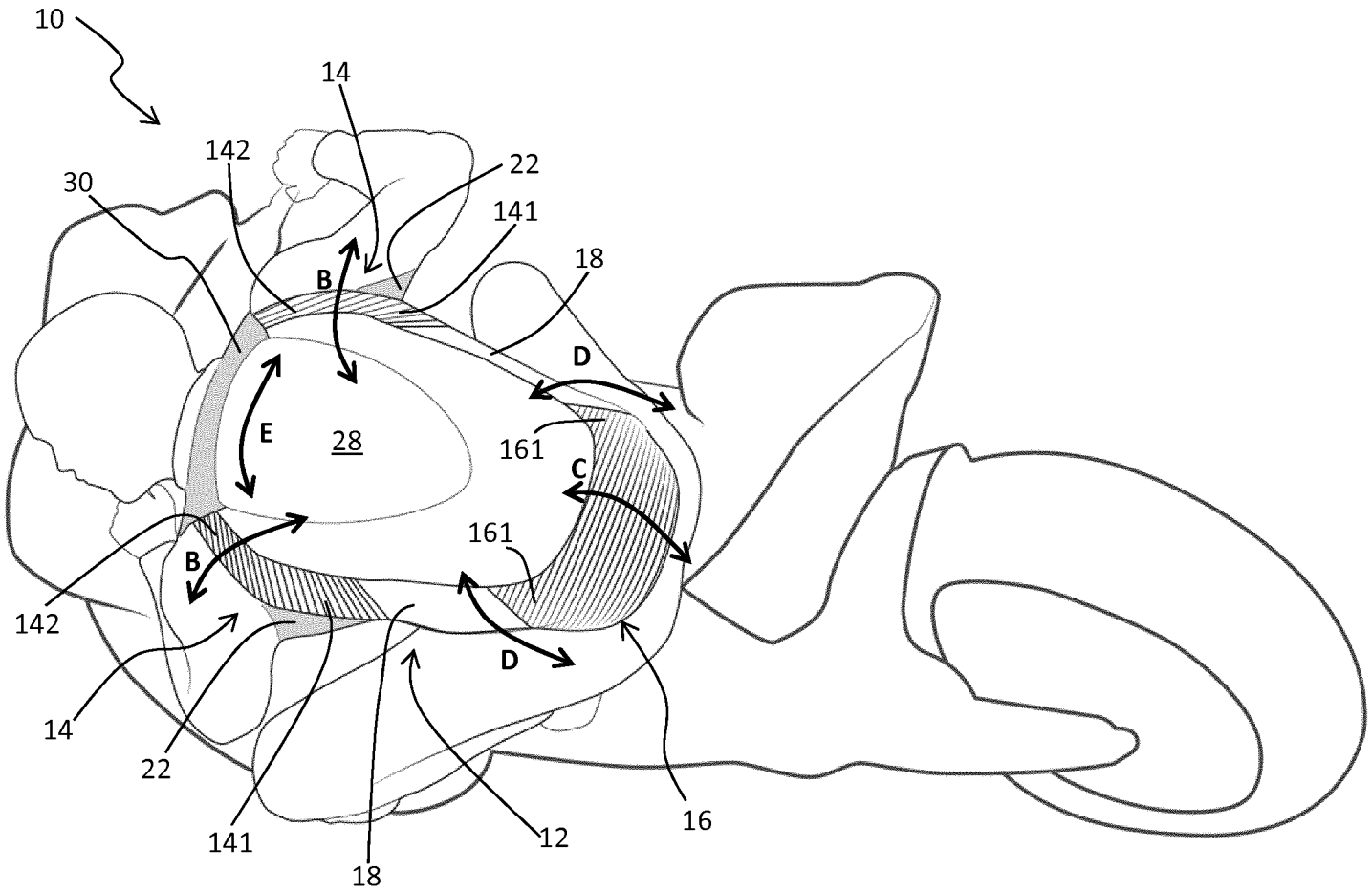
FIG. 5 shows a simplified view of a rider wearing the garment of FIG. 1 when he is sitting on the saddle of a motorcycle.

As it can be easily deduced from the attached figures, the positioning of the stretchable piece 20 on the inner side of the sleeve makes the stretchable piece 20 not visible in a side view of the garment (see for example FIG. 1) and in a top view of the garment (see for example FIG. 5).

In this regards, it should be noted that in FIG. 2, to make more visible where the stretchable piece 20 is positioned, the sleeve of the garment has been rotated so as to simulate a position where the hand of the user is perpendicular to the ground.

According to the invention, each stretchable piece 20 is provided with an extension 22 which extends along the adjacent side of the upper portion of the trunk and is joined to the first portion 141 of the adjacent elastic insert 14.

Preferably, the stretchable piece 20 is made from a stretchable fabric. Advantageously, the stretchable piece 20 can be made using a stretchable Kevlar fiber or yarn so as to combine good elastic properties with a high abrasion resistance.

Preferably the stretchable piece 20 and its extension 22 are a single piece of fabric, having a seamless construction.

Alternatively, the extension 22 can be joined to the stretchable piece 20 by means of seams or similar connecting means.

As it is clearly shown in FIG. 2, the stretchable piece 20 with the extension 22 is shaped to follow the anatomy and motion of the body of the user, so as to assure, together with the adjacent elastic insert 14, great flexibility for the whole shoulder/arm articulation adding comfort to the rider especially while riding the motorcycle.

At the same time, the provision of the extension 22 running along the upper side of the trunk avoids the formation of folds underneath the armpits.

Moreover the extension 22, in combination with the adjacent elastic insert 14, also allows a greater expansion of the chest cage area (as indicated by the double arrow A at FIGS. 1 and 7), which is often put under stress while the rider is competing in a race, causing less resistance/compression to the user's body, without reducing the safety of the garment which follows perfectly the shape of the body.

As it can be seen in FIGS. 1 and 2, the extension 22 preferably has an elongated triangular shape.

Preferably, one of the longer sides of the extension 22 is joined along its whole length to the first portion 141 of the adjacent elastic insert 14, so that the extension 22 extends in proximity of the adjacent not-stretchable element 18.

Figure 7:
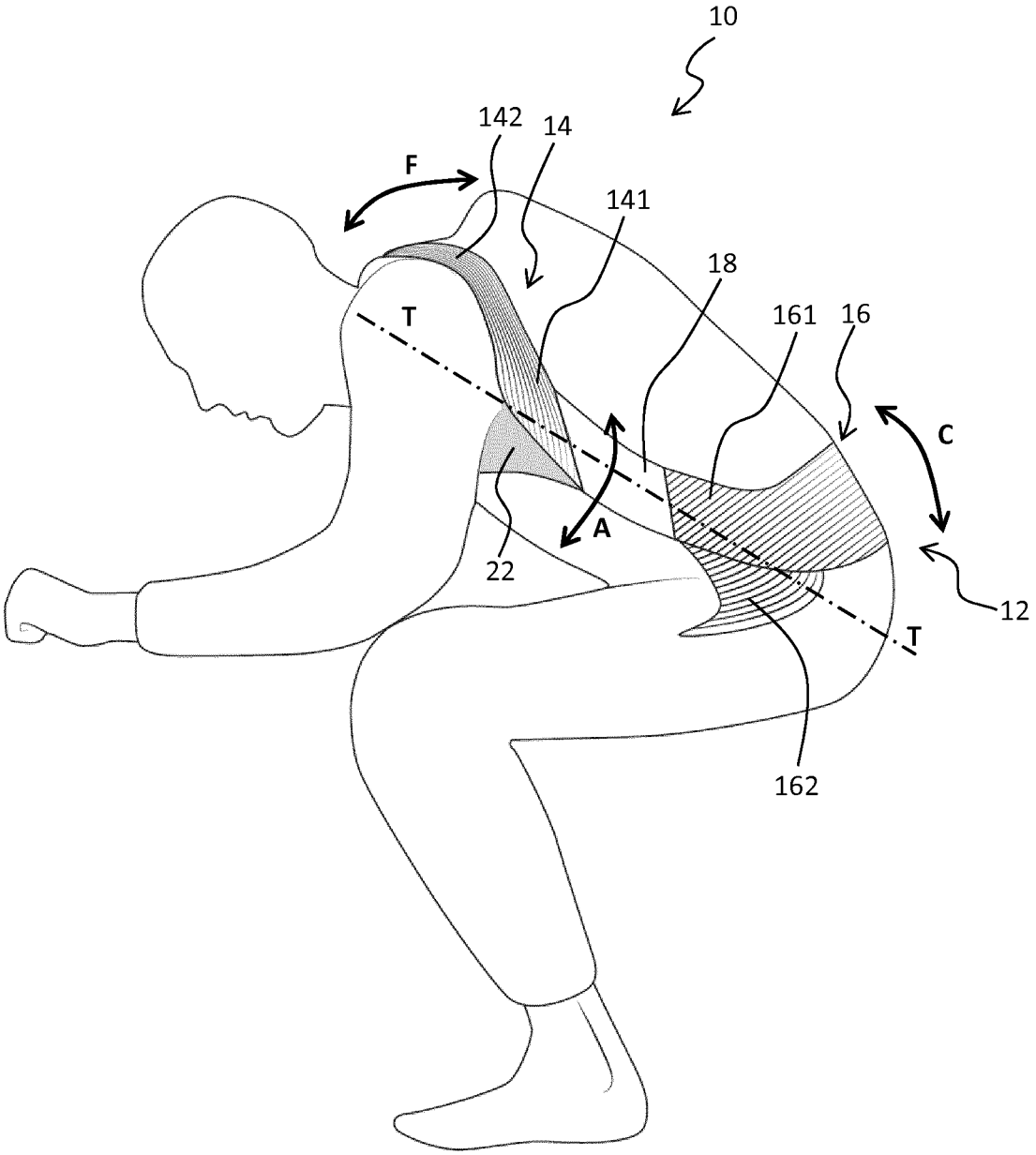
FIG. 7 shows a side view of a second embodiment of the garment according to the invention.

According to a preferred embodiment, the dimensions of the extension 22 are chosen so that the apex of the extension 22 is in touch with the adjacent not-stretchable element 18 (see FIGS. 1, 2 and 7).

As before mentioned, each elastic insert 14 has a first portion 141, designed to extend along the sides of the upper portion of the trunk, underneath the armpits, and a second portion 142 inclined upwards over the shoulder blade.

The inserts 14 are preferably accordion leather stretch inserts, namely are made by superimposing a layer of a thin elastic fabric to a layer of leather. As it is well known in the art, a series of closely stitches are made when the layer of thin elastic fabric is fully tensioned so that as a result a plurality of folds I is created on the insert 14 when it is in rest condition.

Figure 6:
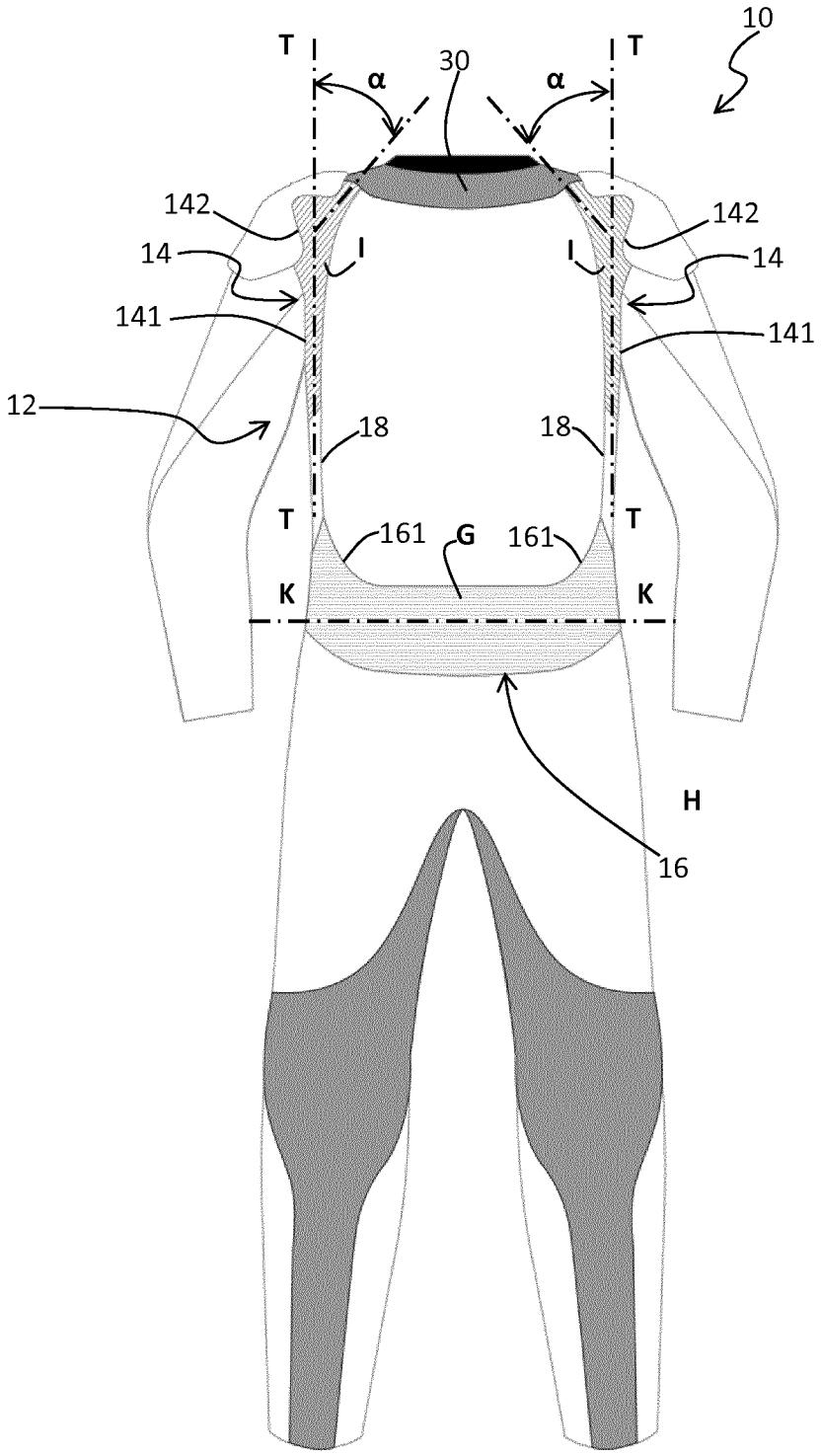
FIG. 6 shows a back view of the garment of FIG. 1.
Figure 9:
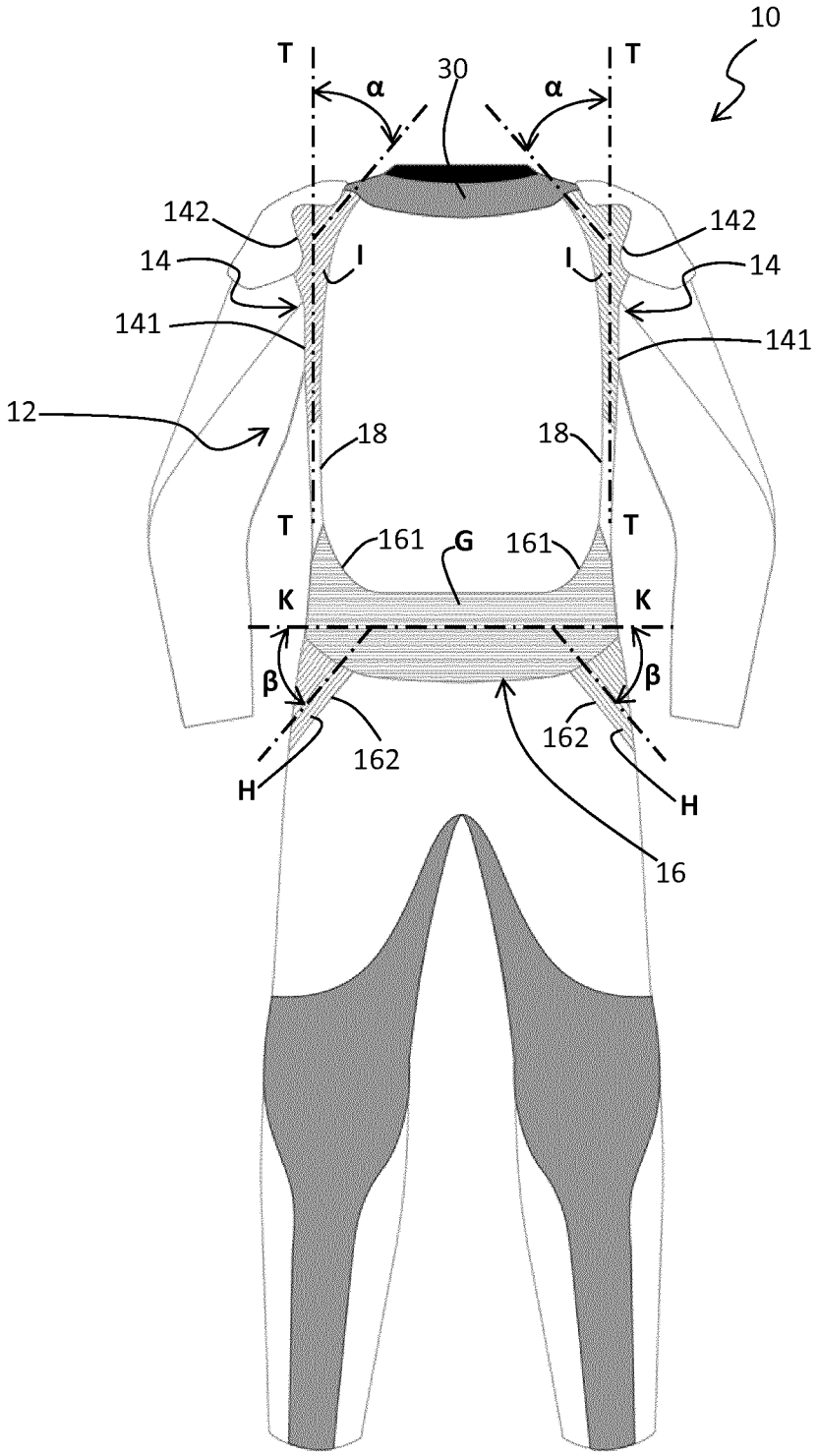
FIG. 9 shows a back view of the garment of FIG. 7.

As shown in FIGS. 6 and 9, the elastic inserts 14 are applied on the garment 10 in such a way that over the whole extension of the elastic inserts 14 the folds I assume, in the configuration which corresponds to rest condition of the garment 10, a position which is inclined at an angle $\alpha$ comprised between 40 and 50 degrees with respect to the longitudinal axis T of the trunk. Preferably the angle $\alpha$ is about 45 degrees.

Being positioned at the upper side portions of the trunk, the elastic inserts 14 assure flexibility to the shoulder/arm especially in riding position (as indicated by the double arrows B in FIGS. 5 and 8), when the rider needs to lean from the bike or stretch forward to reach the handlebars.

These elastic inserts 14 guarantee flexibility when required by the rider's movement, but in rest position they do not create any discomfort or adds crests to the garment 10, without causing problems with the aerodynamics of the garment.

The elastic inserts 14 are connected by means of at least one not-stretchable element 18 to the elastic band 16.

As it is shown in the attached figures, the elastic inserts 14 are preferably connected to the elastic band 16 by means of two not-stretchable elements 18, each one positioned along a corresponding side of the trunk.

In detail, each not-stretchable element 18 can connect the first portion 141 of the elastic insert 14 with the elastic band 16. Preferably, the not-stretchable elements 18 are made with a material resistant to abrasion, for example leather or leather-like material.

Advantageously, the not-stretchable elements 18 can be made of perforated material, for example perforated leather, so as to improve the breathability of the garment.

According to a preferred embodiment of the present invention, the not-stretchable elements 18 have a substantially rectangular or parallelogram shape, with the longer sides disposed parallel to the longitudinal axis T of the trunk (see FIGS. 1 and 7).

As shown in the attached figures, the shorter sides of the not-stretchable elements 18 preferably have dimensions corresponding to the portions of the elastic inserts 14 and the elastic band 16, to which the not-stretchable elements 18 are connected.

Figure 3:
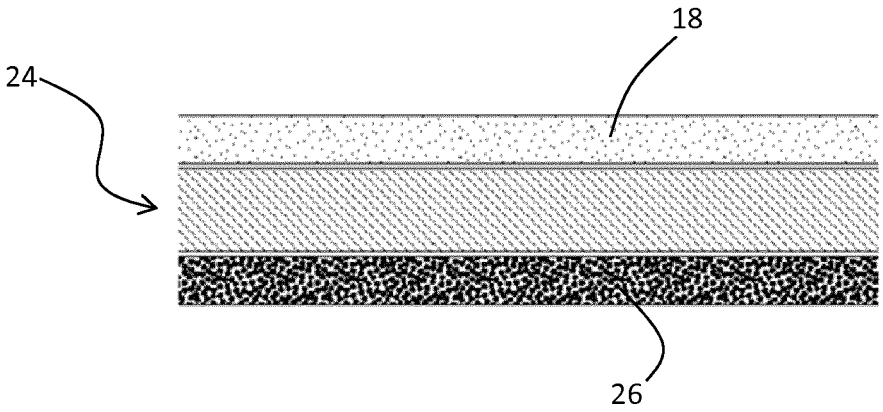
FIG. 3 shows a cross sectional view taken along the line of FIG. 2.

Advantageously, the garment 10 can be provided with protection elements 24 applied at the not-stretchable elements 18 (see FIGS. 3 and 4), so as to offer extra protection to the side of the ribs with respect to the solutions known in the art.

As a matter of fact, for example in the garment disclosed in EP0950360 or in EP 1555900, no rigid or semi-rigid pads can be provided along the sides of the trunk due to the accordion leather stretch panels positioned over there.

Preferably, the protection elements 24 are applied at the inner side of the not-stretchable elements 18. As shown schematically in FIG. 3 each protection element 24 is positioned between the not-stretchable element 18 and an inner fabric 26 of the garment 10. Such an inner fabric 26 preferably is stretchable and is interposed between the protection element 24 and the inner lining of the garment (not shown in the figures).

Preferably, each protection element 24 has shape and dimensions corresponding to those of the not-stretchable element 18 with which it is combined.

Advantageously, the protection element 24 consists of protective impact absorbing foam.

Alternatively the protection element 24 can be a rigid or semi-rigid pad, properly shaped to conform to the anatomy of the sides of the rider.

Figure 4:
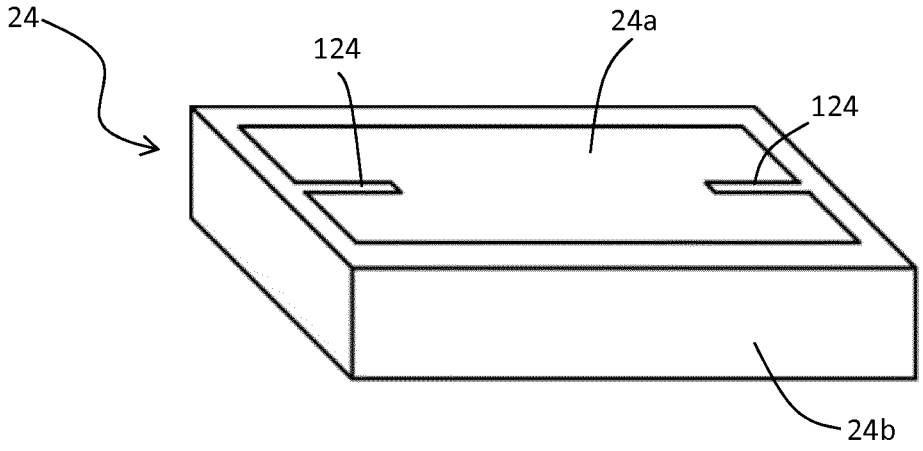
FIG. 4 shows a simplified perspective view of a protection element designed to be positioned along the sides of the garment according to the invention.

In a further embodiment, the protection element 24 can be formed by a rigid plate 24*a* which is applied to a top surface of a protective impact absorbing foam 24*b* (see FIG. 4).

The rigid plate 24*a* preferably is made of polypropylene. Advantageously, the contour of the rigid plate 24*a* can be properly shaped, by providing it with cuts 124 designed to improve the flexibility thereof.

The rigid plate 24*a* can be fixed to the impact absorbing foam 24*b* positioned underneath by means of glue or fasteners, or a combination thereof.

Alternatively, the rigid plate 24*a* can be simply superimposed to the impact absorbing foam 24*b*.

In general, the protection element 24 can be rigidly fixed to the not-stretchable element 18 or to the inner fabric 26. Alternatively, the protection element 24 can be removably inserted inside a pocket or seat formed by fixing the perimeter of the inner fabric 26 to the not-stretchable element 18.

Moreover, the provision of the not-stretchable elements 18 also offers a more reliable connection of the back portion of the garment (namely the portion at least partially enclosed by the panel 12) to the front part, preventing the movements of the back portion of the garment, while the rider slides or tumbles for a long time on his back in case of accident.

In this way the garment remains more firmly attached to the body of the user, keeping all back protections, for example the hump 28, in a proper place, following the movements of the body of the user without restricting them.

As anticipated the elastic band 16 is crosswise positioned along the bottom portion of the back.

Preferably, like the elastic inserts 14, the elastic band 16 is an accordion leather stretch insert, made by superimposing a layer of a stretched thin elastic fabric to a layer of leather, so that a plurality of folds G is created on the band 16, when it is in rest condition.

As shown in FIGS. 6 and 9, the elastic band 16 is applied on the garment 10 in such a way that over the whole extension of the elastic band 16 the folds G, in the configuration which corresponds to rest condition of the garment, are parallel to the axis K of the band 16.

In this way, the elastic band 16 allows the garment 10 to be stretched along the longitudinal axis of the back (as indicated by the double arrow C in FIGS. 1, 5, 7 and 8).

Advantageously, the elastic band 16 can be provided at its side ends with two first extensions 161, each of which extends upwards along the waist area of the garment (see FIG. 1). In this embodiment, the first extensions 161 are the portions of the elastic band 16 designed to be connected to the not-stretchable elements 18.

Figure 8:
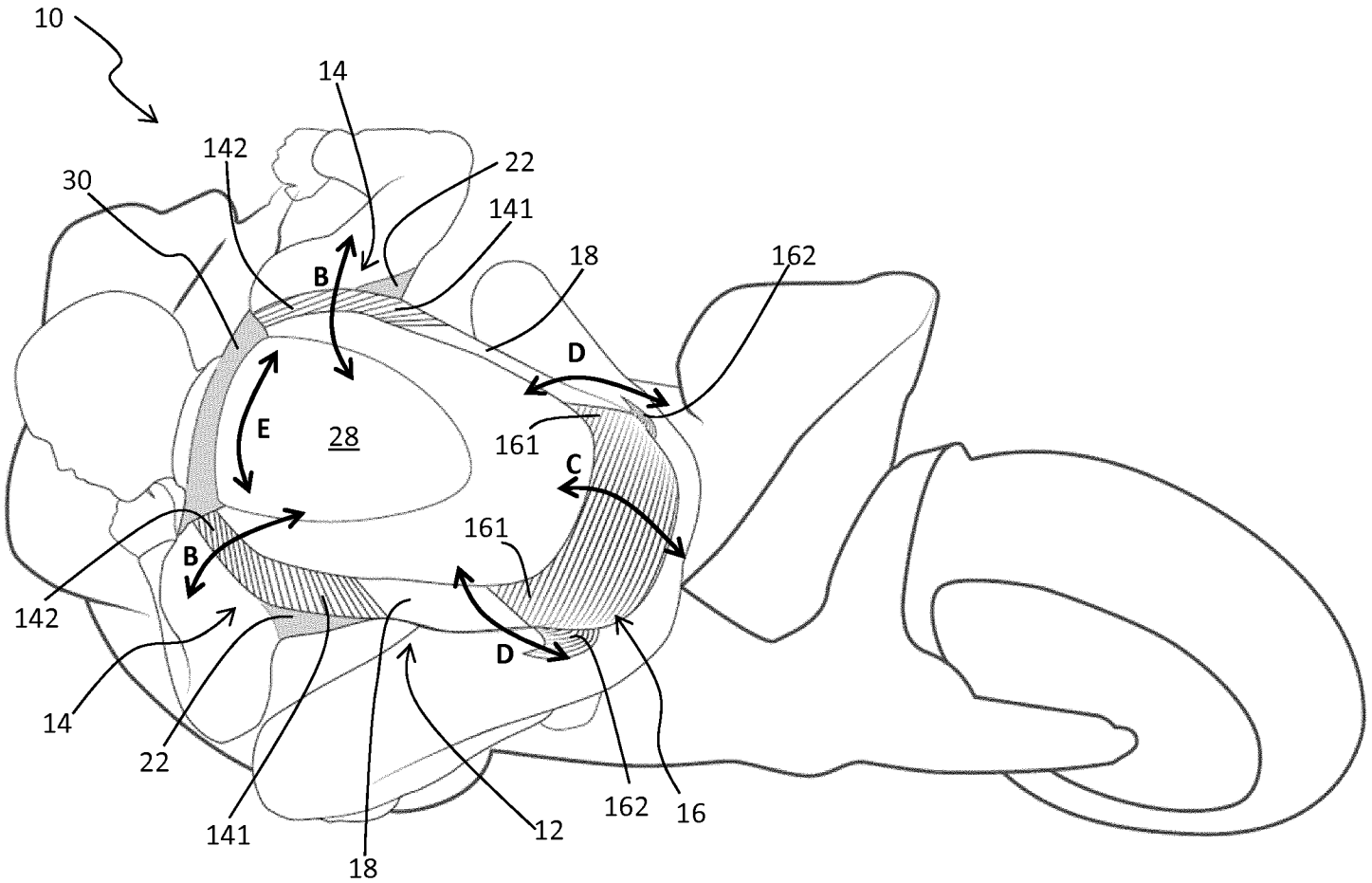
FIG. 8 shows a simplified view of a rider wearing the garment of FIG. 7 when he is sitting on the saddle of a motorcycle.

Advantageously, the provision of the first extensions 161 allows the elastic band 16 to also follow the side movements of the upper body portion, namely left-right (and vice versa) movements of the upper body portion, as indicated by the double arrow D in FIGS. 5 and 8.

In a further embodiment, shown in FIGS. 7-9, the elastic band 16 can be provided at its side ends with two second extensions 162, each of which extends downwards along the hip area of the garment.

Preferably also first and second extensions 161, 162 are accordion leather stretch inserts, namely are made by superimposing, like the elastic inserts 14, a stretched thin elastic fabric with a leather layer so that a plurality of folds is created on the extensions 161, 162 when the latter are in a rest condition.

With reference to FIG. 9, the folds H provided in the second extensions 162 are preferably inclined at an angle β comprised between 40 and 50 degrees with respect to the longitudinal axis K of the band 16. Preferably the angle β is about 45 degrees.

Second extensions 162 work in conjunction with first extensions 161 to allow the side movements of the upper body portion.

Moreover, as it is well known in the art, in case the garment is provided with an airbag protection, namely an inflatable member positioned along the back and the side portions of the garment, first extension 161 and second extension 162 allow an easier side expansion of the inflatable member, so as to assure that the body of the rider is not compressed by the inflatable member once the latter is inflated.

Furthermore, as it is shown in FIGS. 5-6 and 8-9, the garment 10 can be provided with a further stretchable panel 30 running across the upper back portion of the garment 10.

The stretchable panel 30 is preferably made with a stretchable fabric. Advantageously, the stretchable panel 30 can be made using a stretchable Kevlar fiber or yarn so as to combine good elastic properties with a high abrasion resistance.

The stretchable panel 30 connects to each other the second portions 142 of each elastic insert 14. In this way, the panel 12, which is formed by the elastic inserts 14, the not-stretchable elements 18, the elastic band 16 and the stretchable panel 30, encircles the back portion of the garment 10.

The stretchable panel 30 works in combination with the elastic inserts 14 offering to the shoulder area extra flexibility, as indicated by the double arrow E in FIGS. 5 and 8. In this way, the rider can extend the elbow further down and further forward, so as to be able to adapt his riding style to the recent improvements introduced in the racing equipment (new compounds used for the tires, new electronic controls, etc.) which allow the motorcycle to be bent more than in the past.

Moreover, the stretchable panel 30 does cooperate with the elastic band 16 so as to allow the garment 10 to be further stretched along the longitudinal axis of the back at the upper portion of the back (as indicated by the double arrow F in FIGS. 1 and 7). Basically, the stretchable panel 30 allows the upper portion of the garment 10 to be further stretched while the rider leans forward, following the front forward movement of the torso.

It is thus clear how the predefined objects may be achieved with the garment 10 according to the invention.

As a matter of fact, the garment of the present invention offers an improved comfort to the rider without causing an increase in weight or a worsening of the aerodynamics. The extension 22 working in combination with the elastic insert 14 assures that the garment remains adherent to the body, avoiding the formation of crests under the armpits.

At the same time, the extension 22 increases the comfort at the shoulder area and at the side trunk area, without affecting the aerodynamics of the garment.

Moreover, with respect to the known solutions, the garment of the present invention allows to reduce the portions of the suit made with accordion leather stretch inserts or panels and thus to reduce the weight of the garment, without affecting the comfort. At the same time, in case of an accident, it is undoubtedly easier and less costly to replace the not-stretchable elements 18, with respect to an accordion leather stretch insert.

Furthermore, the garment of the present invention offers an improved protection along the sides of the user thanks to the provision of side protections, namely the protection elements 24.

Also the manufacture of the garment is simplified, since the panel 12 can be applied as a single piece to the back portion of the garment, after having connected to each other its various components. Moreover, also the reduction of the area covered by the accordion leather stretch inserts simplified the manufacture of the garment.

Finally, the garment of the present invention can advantageously be used in combination with inflatable protective devices positioned inside the garment.

As a matter of fact, the various stretchable elements of the garment are also able to favor the expansion of the inflatable members positioned inside the garment, if any.

With regard to the embodiments of the garment 10 described above, the person skilled in the art may, in order to satisfy specific requirements, make modifications to and/or replace elements described with equivalent elements, without thereby departing from the scope of the accompanying claims.

The invention claimed is:

1. A garment for motorcyclists comprising a panel formed by two elastic inserts and by an elastic band, each elastic insert having a first portion, configured to be positioned underneath a respective armpit and along a side of an upper portion of a trunk of a wearer of the garment, and a second portion, configured to be inclined upwards over a respective shoulder blade of the wearer, and the elastic band configured to be positioned crosswise along the bottom portion of a back of the wearer, characterized in that the two elastic inserts are connected to the elastic band by means of at least one non-stretchable element, configured for running along sides of a torso of the wearer, and in that the garment comprises two further stretchable pieces, each stretchable piece configured for running along an inner side of a sleeve of the wearer from wrist up to the respective armpit and being provided with an extension configured for extending along an adjacent side of the upper portion of the trunk and joined to the first portion of an adjacent one of the two elastic inserts.

2. The garment according to claim 1, characterized in that the extension has an elongated triangular shape.

3. The garment according to claim 2, characterized in that a whole length of a longer side of the extension is joined to the first portion of the adjacent one of the two elastic inserts, so that the extension extends in proximity of the adjacent non-stretchable element.

4. The garment according to claim 2, characterized in that a apex of the extension is in touch with the adjacent non-stretchable element.

5. The garment according to claim 1, characterized in that each stretchable piece is made with a stretchable fabric.

6. The garment according to claim 5, characterized in that each stretchable piece and the extension are a single piece of stretchable fabric, having a seamless construction.

7. The garment according to claim 1, characterized in that the two elastic inserts are connected to the elastic band by means of two non-stretchable elements, each positioned along a corresponding side of the wearer's trunk.

8. The garment according to claim 1, characterized in that the at least one non-stretchable element is made with a material resistant to abrasion.

9. The garment according to claim 1, characterized in that the at least one non-stretchable element has a substantially rectangular or parallelogram shape;

longer sides of the at least one non-stretchable element being disposed parallel to a longitudinal axis of the wearer's trunk.

10. The garment according to claim 1, further comprising a protection element applied at the at least one non-stretchable element.

11. The garment according to claim 10, characterized in that the protection element is applied at an inner side of the at least one non-stretchable element, the protection element being positioned between the at least one non-stretchable element and an inner fabric of the garment.

12. The garment according to claim 10, characterized in that the protection element is made of a protective impact absorbing foam.

13. The garment according to claim 1, characterized in that the elastic band is provided with side ends with two first extensions, each of the two first extensions extending upward along an area of the garment configured to be at a waist of the wearer.

14. The garment according to claim 1, characterized in that the elastic band is provided with side ends with two second extensions, each of the two second extensions extending downward along an area of the garment configured to be at a hip of the wearer.

15. The garment according to claim 1, further comprising a further stretchable panel running across a portion of the garment configured to be at an upper portion of a back of the wearer;

the further stretchable panel connecting the second portions of each elastic insert.

* * * * *